United States Patent [19]

DePaolo et al.

[11] 4,333,271

[45] Jun. 8, 1982

[54] HURRICANE PANEL SECURITY DEVICE

[75] Inventors: James F. DePaolo, Coral Springs; Joseph T. Hale, Miami; Carl F. Holmberg, Miami, all of Fla.

[73] Assignee: Nichols-Homeshield, Inc., Aurora, Ill.

[21] Appl. No.: 243,470

[22] Filed: Mar. 13, 1981

[51] Int. Cl.[3] ..... E06B 3/32

[52] U.S. Cl. ..... 49/464; 52/202

[58] Field of Search ..... 49/463, 464, 57, 61; 52/202, 203

[56] References Cited

U.S. PATENT DOCUMENTS

| | | | |
|---|---|---|---|
| 909,111 | 1/1909 | Paulson | 49/464 X |
| 1,606,092 | 11/1926 | Miller | 49/464 X |
| 2,622,285 | 12/1952 | Roos | 52/202 |
| 2,878,536 | 3/1959 | Becker | 49/464 X |

*Primary Examiner*—Philip C. Kannan

*Attorney, Agent, or Firm*—McWilliams, Mann & Zummer

[57] ABSTRACT

This invention relates to hurricane panel installations of the type designed to be installed to cover windows and doors against the effects of wind and atmospheric conditions which might otherwise have the effect of destroying the windows and doors and which includes a tamper proof security means of preserving the installation against unauthorized removal of the panel to gain entrance to the premises. This security means is installed at the outer side of the panel in engagement with a securing device to prevent withdrawal of the securing device and the security means is secured from the inner side of the panel where an intruder would not have access so that the panel could only be released from the inside by an occupant of the premises, after which it could be removed from the outside.

7 Claims, 5 Drawing Figures

HURRICANE PANEL SECURITY DEVICE

BACKGROUND OF THE INVENTION

1. Field of the Invention

The invention relates to hurricane panels that are adapted to cover door and window openings in a building on a temporary basis when a storm is forecast and which are removed after a storm has passed and stored conveniently for future use.

2. Description of the Prior Art

Hurricane panels for building openings have been achieved in the past by boarding up such openings by applying a number of boards across each opening and nailing the boards in place. Plywood panels have been similarly applied and taping of glass areas as a means of reinforcement has also been resorted to and which was intended also to prevent flying glass in the event of breakage. Plastic panels have been utilized but metal panels afford the greatest protection and these have been installed in one piece covering the entire area of an opening, or in a number of pieces which together cover the opening area.

Hurricanes may inflict severe damage on a building where it may not be prepared since tropical storms attain hurricane status when sustained winds reach 74 M.P.H. or more and wind speeds of 90 to 100 M.P.H. commonly occur in Florida hurricanes. Such winds can cause heavy damage to the buildings of unprepared homeowners and one of the most dangerous elements is flying debris which may be comprised of elements picked up by the wind and propelled like weapons into exposed glass areas and do maximum damage and possibly inflict injury to persons, or occupants of the buildings. Another consequence of hurricanes, such as those encountered in Florida, lies in the rough seas and high tides as the storm approaches the shore. These tides may reach three feet and as much as ten feet above normal and the surge resulting from such tides exerts tremendous pressures on anything in the path of the surging water and wreak great devastation to homes in coastal areas and expecially low lying sections. Hurricane panels must be in place prior to the approach of the storm and should be installed even when a tropical storm is forecast since these storms frequently develop into full blown hurricanes.

SUMMARY OF THE INVENTION

This invention provides a metal enclosure for door and window openings in the form of a full panel comprised of a series of individual panels arranged in overlapping relationship with the upper end of the full panel disposed in a downwardly open header channel and fixed at the bottom to secure the entire panel over the open area. The individual panels are constructed of sheet metal, corrugated to provide vertically extending corrugations running continuously from top to bottom of the panel and these corrugations at the adjoining edges of the panels are overlapped and interlocked to provide, in effect, a single overall panel structure for each building opening.

The panel structure is supported at the bottom on an outstanding flange of a sill member and is adapted to bear against an upstanding flange of the sill where it is secured by spring clips extending through and interengaged with the outstanding flange. The spring clips are disposed at the outer side of the panel structure and are maintained against unauthorized withdrawal by a security bar disposed in the space beneath the outstanding flange where the lower portion of the spring clip extends at an inward angle toward a depending flange of the sill member.

In the position described the security bar not only prevents the spring clips from being withdrawn but also encloses the fastening means securing the sill to the building structure so that the sill cannot be removed in order to remove the panel and thus gain access to the building. The security bar is fastened against removal by means of pin locks which are installed from the inside so that the integrity of the panel installation is maintained to insure the security of the premises. It is the primary purpose of the invention to provide this security by preventing removal of the outside clips fastening the panel structure to the building with one or more locking members applied from the inside to preclude withdrawal of the member securing the clips.

DESCRIPTION OF THE DRAWINGS

The structure and arrangement described affording all of the advantages hereinafter disclosed is illustrated in the accompanying drawings, wherein.

DESCRIPTION OF PREFERRED EMBODIMENT

Figure 1:
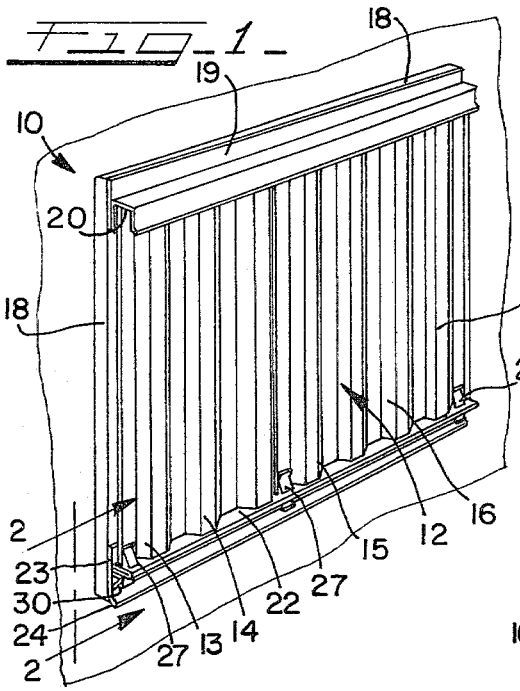
FIG. 1 is is a general perspective view of a hurricane panel installation over a window opening in a building.
Figure 4:
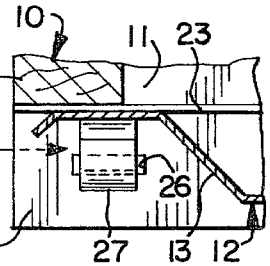
FIG. 4 is a fragmentary plan section through a corrugated panel applied to a window opening of a building with the security bar fully installed behind the fastening clips and showing a locking pin within the area of a corrugation at the inside in position to engage the security bar.
Figure 4:
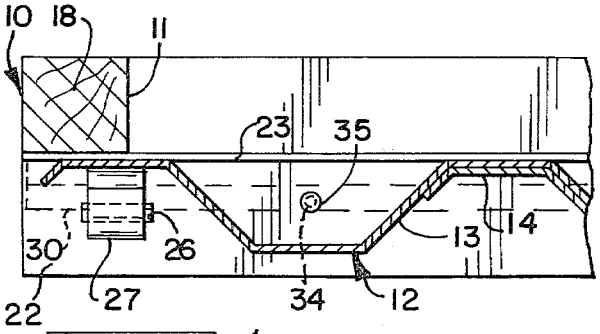

In the drawings the numeral 10 represents a building structure having a window opening 11 which is illustrated in FIG. 1 as being protected by a hurricane panel 12 which is actually comprised of a series of overlapping individual panels 13, 14, 15, 16 and 17. These individual panels are disposed in overlapping engagement at their adjoining edges, as best indicated in FIG. 4, so that the several panels are thus interlocked whereby, when installed as hereinafter described, they will be maintained in assembled relationship. The individual panels may each include one or more vertically extending corrugations running continuously from top to bottom of the panels and when assembled in interlocking relationship the panels act and function like a single full panel structure covering the window opening 11.

A rectangular framework 18 may be built out from the building structure 10 and surrounds the window opening 11. A header member 19 having a downwardly opening channel 20 is mounted on and secured to this framework at the upper side of the window opening. Similarly, at the lower side of the window opening, a sill member 21 is secured to the framework 18 and both the header 19 and the sill 21 extend across the full width of the window opening in vertically aligned relationship. The sill 21 includes an outstanding horizontal flange 22, an upstanding vertical flange 23 and a depending flange 24. A plurality of fastening bolts 25 secure the sill 21 to the building structure through the depending flange 24.

When the assembled panel structure 12 is to be installed over the window opening 11 in advance of an approaching storm, the panels are inserted into the header channel 20 and supported on the horizontal flange 22 at the lower side of the window opening with the panels bearing against the upstanding flange 23. The flange 22 is provided with a plurality of rectangular openings 26 at spaced intervals and disposed in the areas defined by the valley portions of the panel corrugations, as shown best in FIGS. 3 and 4. These slots 26 are for the purpose of receiving fastening clips 27 which are inserted through the slots after the storm panels have been disposed in place and bear against the panels at the upper side of the flange 22 and against the flange 24 below the flange 22 (see FIGS. 2 and 5). The clips 27 have a spring action and are provided with an offset 28 midway of their upper and lower extent, where the clips pass through the sill openings 26, so that the effect of this offset is to interengage with the flange 22 to prevent vertical displacement of the clip. The clips each have outwardly curved end portions 29 at the upper and lower ends where they engage the storm panels and the sill flange 24 respectively.

With the hurricane panels installed over the window opening and the fastening clips 27 in place the panels are securely maintained in position over the building opening to prevent any damage from wind forces that might be directed against the otherwise exposed glass areas. The most important object of this installation is to maintain the safety and security of the applied panels and to prevent their unauthorized removal. The fastening clips 27 are disposed on the outer side of the panels and of course, might readily be removed by anyone and the storm panel thus readily disengaged from over the window opening whereby easy access to the interior of the building could be had.

To prevent the fastening clips 27 from being withdrawn by anyone other than the building owner, a security bar 30 is inserted through the several spring clips 27 at the underside of the sill flange 22 and extends the full width of the installation so that all of the clips are engaged and prevented from being withdrawn either upwardly or downwardly through the sill slots 26. Looking especially at FIG. 2, it will be seen that the security bar 30 will engage the offset 28 of the clip to prevent it from being shifted to work it either upwardly or downwardly through the slot 26, the clip being constructed rigidly enough to preclude its being straightened out in any effort to force it in either direction through the slot, so that the interengagement of the offset position 28 with the flange 22 will be maintained.

The security bar 30 has a top horizontal flange 31, a vertical flange 32 and an inwardly sloping flange 33 with the flange 31 bearing against the under side of the sill flange 22 and the bottom end of the sloping flange 33 engaging the outer face of the depending sill flange 24 as well as being in engagement with the upper side of the inwardly sloping flange of the fastening clip 27 near the bottom end 29 where it contacts the face of the sill flange 24. Thus the security bar might be said to be somewhat snugly fitted into the area defined by the vertical and horizontal flanges 24 and 22 of the sill and the inwardly sloping bottom flange of the fastening clip. In this position it most effectively functions to maintain the clips against any possibility of extraction.

A most important feature of the security bar installation resides in the fact that it is secured at the inside of the panel 12. A series of spaced holes 34 is provided through the flange 31 of the security bar and correspondingly spaced holes through the sill flange 22 so that when the security bar is inserted into place the holes are aligned. One or more locking pins 35 are inserted through these aligned holes from the inner sides of the storm panel 12. These vertically aligned holes 34 are disposed within the area defined by the panel corrugations at the inner side thereof so that the locking pins 35 may be dropped in, or removed, from inside the building.

It will be noted that the locking pins 35 extend only through the top flange 31 of the security bar and do not pass through the sloping flange 33 so that the pins cannot be driven upwardly from the bottom, thus the locking pins themselves are protected by the security bar. Thus, it becomes apparent that the hurricane panel 12 is rendered most secure against any possibility of removal other than by the occupant of the building premises. With the pins 35 removed, it becomes possible to slide the security bar lengthwise out of the space it occupies to secure the clips 27.

Figure 2:
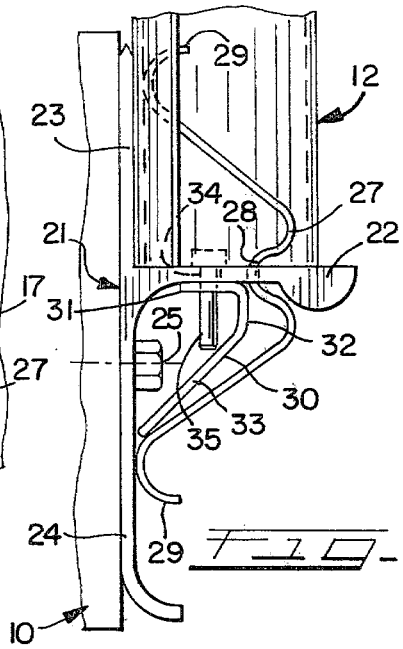
FIG. 2 is a detail end view, to larger scale, taken from the position 2-2 in FIG. 1.
Figure 3:
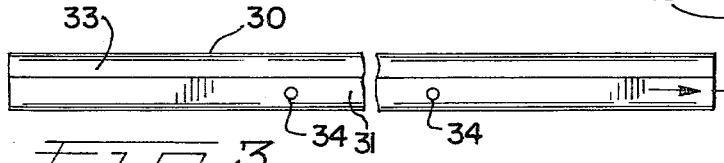
FIG. 3 is a fragmentary plan view showing the security bar in position to be inserted behind the fastening clips for the panel.
Figure 5:
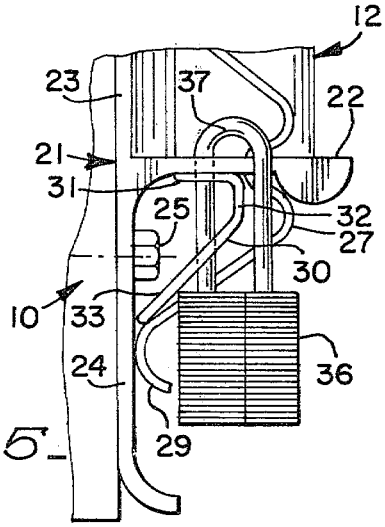
FIG. 5 is an end view similar to FIG. 2 but showing a padlock engaged through the sill and security bar for locking the bar against removal.

It should be noted that a further security feature is obtained by the placement of the security bar 30 in the particular position illustrated especially in FIGS. 2 and 5. As shown, the bar 30 overlies and encloses the fastening bolts 25 which secure the sill 21 to the building structure 10, so that these bolts cannot be removed so long as the security bar is in place. Thus, the sill 21 cannot be removed and with it the hurricane panel 12 for access to the building interior.

A modified form of locking arrangement for the security bar 30 is illustrated in FIG. 5. As shown here a padlock 36 is utilized to lock the security bar relative to the sill flange 22. The hasp 37 of the lock is passed through suitable openings in the sill flange and both flanges 31 and 33 of the bar so that with the padlock in place the security bar is effectively secured against lengthwise movement relative to the sill 21. In this type of locking arrangement the padlock installation is made adjacent to one end of the sill and security bar where it will be accessible beyond the extent of the hurricane panel.

From the foregoing, it will readily be seen that a very secure hurricane panel installation has been provided that includes an effective locking arrangement positively preventing unauthorized access to the premises by preventing removal of attachment devices for the panel and enclosing structural attachments whereby to preclude their being removed to release the panel and utilizing locking devices that are accessible only from the interior of the building premises.

What is claimed is:

1. A hurricane panel installation having a header disposed adjacent the top of a building opening and a sill disposed adjacent the bottom of the opening, a hurricane panel extending into said header and supported on said sill, one or more fasteners extending vertically through a portion of the sill and engaging the hurricane panel above said portion and in contact with another part of the sill below said portion, a security member beneath said sill portion in engagement with said fasteners to prevent their removal, and a locking member extending through said sill portion and engaging the security member to lock the security member against displacement.

2. A hurricane panel installation as set forth in claim 1 wherein said sill is secured to the building by fastenings exposed on the outer side of the sill, and said security member encloses said fastenings.

3. A hurricane panel installation as set forth in claim 1 wherein said portion of the sill comprises an outwardly directed flange and said another part comprises a depending flange of the sill, one or more vertical openings through the outwardly directed flange, said fasteners extending through said openings, and said security member comprises a lengthwise extending bar having a horizontal top flange, a depending vertical flange and an inwardly sloping flange extending toward said depending flange of the sill.

4. A hurricane panel installation as set forth in claim 3 wherein said locking member extends through the horizonal top flange of the security bar and said depending vertical flange engages said fasteners to prevent withdrawal through said openings.

5. A hurricane panel installation as set forth in claim 4 wherein said fasteners each have an offset where they pass through said openings, said offset interengaging with the outwardly directed flange and cooperating with the security bar in preventing withdrawal of the fasteners.

6. A hurricane panel installation as set forth in claim 5 wherein said sill member includes an upwardly directed flange against which said hurricane panel is held by said fasteners above the outwardly directed flange.

7. A hurricane panel installation as set forth in claim 6 wherein said locking member comprises a padlock having a hasp member extending through said outwardly directed flange of the sill member, through said horizontal top flange of the security bar and through the inwardly sloping flange of the security bar.

* * * * *